US009079432B2

(12) United States Patent
Sato

(10) Patent No.: US 9,079,432 B2
(45) Date of Patent: Jul. 14, 2015

(54) SHEET CONVEYING DEVICE WITH SHEET EDGE GUIDE DOWNSTREAM OF BUFFER UNIT

(71) Applicant: CANON KABUSHIKI KAISHA, Tokyo (JP)

(72) Inventor: Ryosuke Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/032,603

(22) Filed: Sep. 20, 2013

(65) Prior Publication Data

US 2014/0091127 A1 Apr. 3, 2014

(30) Foreign Application Priority Data

Sep. 28, 2012 (JP) ..... 2012-217259

(51) Int. Cl.

| | |
|---|---|
| ***B41J 15/04*** | (2006.01) |
| ***B65H 23/032*** | (2006.01) |
| ***B65H 20/32*** | (2006.01) |
| ***B65H 20/34*** | (2006.01) |
| ***B65H 23/038*** | (2006.01) |
| ***B41J 11/00*** | (2006.01) |
| ***B41J 15/00*** | (2006.01) |

(52) U.S. Cl.

CPC ..... *B41J 15/046* (2013.01); *B41J 11/0005* (2013.01); *B41J 15/005* (2013.01); *B65H 20/32* (2013.01); *B65H 20/34* (2013.01); *B65H 23/038* (2013.01); *B65H 23/0322* (2013.01); *B65H 2301/51212* (2013.01)

(58) Field of Classification Search

CPC ..... B65H 23/34; B65H 23/042; B65H 20/32; B65H 20/34; B65H 2301/51212; B65H 2408/214; B41J 15/005; B41J 15/046

See application file for complete search history.

(56) References Cited

U.S. PATENT DOCUMENTS

| | | | | |
|---|---|---|---|---|
| 4,253,597 | A * | 3/1981 | Waffner | 226/40 |
| 4,415,109 | A * | 11/1983 | Pfister | 226/181 |
| 6,224,280 | B1 * | 5/2001 | Buckley et al. | 400/613 |
| 8,079,589 | B2 | 12/2011 | Kinoshita et al. | |
| 2002/0011170 | A1 * | 1/2002 | Kuwabara et al. | 101/484 |
| 2011/0012972 | A1 * | 1/2011 | Nitta | 347/104 |
| 2011/0266742 | A1 * | 11/2011 | Sato et al. | 271/228 |
| 2013/0099046 | A1 | 4/2013 | Izumi et al. | |
| 2013/0100223 | A1 | 4/2013 | Sato et al. | |

FOREIGN PATENT DOCUMENTS

JP 2011-240997 A 12/2011

* cited by examiner

*Primary Examiner* — Daniel J Colilla

(74) *Attorney, Agent, or Firm* — Fitzpatrick, Cella, Harper & Scinto

(57) ABSTRACT

A sheet conveying device that more appropriately corrects a positional deviation for a sheet and reduces the time required for a correction of the positional deviation. The sheet conveying device includes a guide unit, for guiding the edges of the sheet that is conveyed and for correcting a positional deviation, and a buffer unit located upstream of the guide unit to form a slack for the sheet, so that one part of the slack formed by the buffer unit is guided by the guide unit. The buffer unit includes an upstream roller pair and a downstream roller pair, and a slack for the sheet is formed between the upstream roller pair and the downstream roller pair.

11 Claims, 8 Drawing Sheets

SHEET CONVEYING DEVICE WITH SHEET EDGE GUIDE DOWNSTREAM OF BUFFER UNIT

BACKGROUND OF THE INVENTION

1. Field of the Invention

The present invention relates to a sheet conveying device that conveys, a continuous sheet and that corrects, if necessary, a positional deviation of the sheet that is being conveyed.

2. Description of the Related Art

In a processing operation during which an apparatus conveys a continuous sheet, wound like a roll, to perform printing, when a positional deviation occurs on the sheet, an image formation position would be shifted from a predetermined location, and the quality of an image could be degraded. Therefore, it is preferable that the positional deviation of the sheet be corrected during the conveying of the sheet. According to an apparatus disclosed in Japanese Patent Laid-Open No. 2011-240997, the positional deviation is corrected by pressing the sheet and bringing the edge of a sheet into contact with a guide member.

For the correction of a positional deviation, generally, conveying of the sheet is temporarily halted, and the guide member is pressed against the edge of the sheet. To temporarily halt the conveying of the sheet, it is required that a plurality of conveying rollers, employed to convey the sheet, be halted at the same time. When there is a time lag in stopping a plurality of conveying rollers to halt the conveying of the sheet, there is a possibility that the sheet will be pulled or loosened, and a scratch mark or a mark by a roller may be left on the sheet. Furthermore, since all of the conveying rollers that nip the sheet must be halted to correct the positional deviation, an extended period of time may be required for the correction of the positional deviation.

SUMMARY OF THE INVENTION

While taking the above described problem into account, one objective of the present invention is to provide a sheet conveying device that can more appropriately correct a misalignment, such as a positional deviation, of a sheet, and can reduce the period of time required for such a correction.

According to the present invention, a sheet conveying device comprising: a guide unit for guiding edges of a sheet that is conveyed, and for correcting a positional deviation for the sheet; and a buffer unit located upstream of the guide unit for forming a slack for the sheet, wherein one part of the slack formed by the buffer unit is guided by the guide unit.

According to the present invention, since a misalignment, such as a positional deviation, for the sheet is more appropriately corrected, conveying of the sheet can be more accurately performed. Furthermore, since a period of time required for the correction can be reduced, the conveying of the sheet can be performed more efficiently.

Further features of the present invention will become apparent from the following description of exemplary embodiments (with reference to the attached drawings).

DESCRIPTION OF THE EMBODIMENTS

Figure 1:
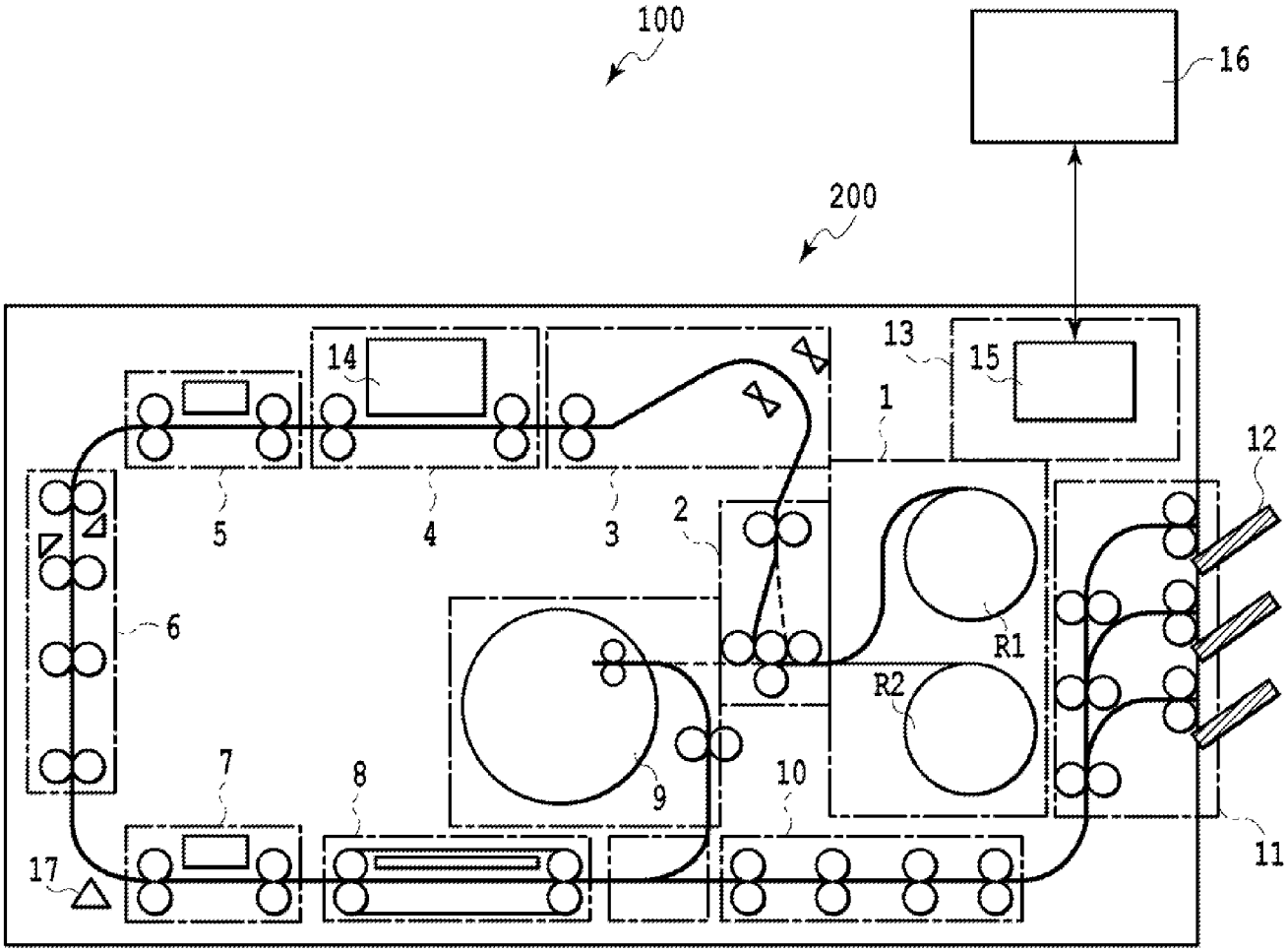
FIG. 1 is a schematic cross-sectional view of a printing apparatus that includes a sheet conveying device according to one embodiment of the present invention.

A sheet conveying device according to one embodiment of the present invention will now be described while referring to the accompanying drawings. FIG. 1 is a schematic cross-sectional view of a printing apparatus 100 of ink jet type that includes a sheet conveying device 200 according to this embodiment.

For the printing apparatus 100 of this embodiment, a sheet wound like a roll is employed as a printing medium. A print head ejects ink onto the sheet to perform printing with conveyance of one sheet end of the rolled sheet. In this embodiment, the sheet is longer than length of a unit image to be printed (called one page, or also called a unit image) in a conveying direction, and is provided as a continuous sheet.

The printing apparatus 100 is a high-speed inline head printer that copes with both single-sided printing and double-sided printing. The printing apparatus 100 of this embodiment is appropriate for printing of a large number of sheets, such as printing at print labs. In the specification of this invention, even when a plurality of small images, characters or blanks are included in one print unit (one page), all of the images included in this area are collectively called one unit image. That is, one unit image is referred to as one print unit (one page) in a case wherein a plurality of pages are to be printed on a continuous sheet. The length of the unit image varies in accordance with the size of an image to be printed. For example, for an L size (3R size) photo, the length of a unit image is 135 mm in the sheet conveying direction, and for A4 size, the length of a unit image is 297 mm in the sheet conveying direction.

The printing apparatus 100 of this embodiment can perform double-sided printing for a roll-shaped sheet, i.e., perform printing on the first side of the sheet and the second side, which is the reverse of the first side. The printing apparatus 100 mainly includes a sheet feeding unit 1, a decurling unit 2, a positional deviation correction unit 3, a printing unit 4, an inspection unit 5, a cutter unit 6, an information recording unit 7, a drying unit 8, an inversion unit 9, a delivering/conveying unit 10, a sorter unit 11, a discharging unit 12 and a control unit 13. The sheet is conveyed along a sheet conveying path, indicated by solid lines in FIG. 1, by a conveying mechanism that includes roller pairs and a belt, and is processed by the individual units. It should be noted that an arbitrary position along the sheet conveying path closer to the sheet feeding unit 1 is regarded as "upstream", while a position on the opposite side is regarded as "downstream".

The sheet feeding unit 1 is a unit that supports and feeds a continuous sheet wound like a roll, and can store two rolls R1 and R2. The sheet feeding unit 1 can selectively pull one of the rolls R1 and R2, and supply the sheet to the conveying path. In this embodiment, the sheet feeding unit 1 includes a construction that two rolls can be stored; however, the number of rolls to be stored is not limited to two, and one roll, or three or more rolls may be stored.

The decurling unit 2 is a unit that reduces a curl (warp) of the sheet fed by the sheet feeding unit 1. The decurling unit 2 employs two pinch rollers, with respect to one drive roller, and bends the sheet to curl the sheet in a direction opposite to the direction in which the sheet was curled when the paper roll was stored. As a result, the decurling unit 2 applies a decurling force to the sheet to reduce the curling on the sheet. Therefore, when the sheet is conveyed, the curl of the sheet wound into a roll shape is reduced.

The positional deviation correction unit 3 is a unit that corrects positional deviation of the sheet that has passed the decurling unit 2 (the orientation of the sheet relative to the original traveling direction). To correct the positional deviation, the sheet edge is pressed and is contact with a guide member on a reference side.

Print heads 14 are arranged in the printing unit 4. The print heads 14 perform printing on the sheet that is conveyed, and form images on the sheet. That is, the printing unit 4 is a printing processer that performs a predetermined printing process for the sheet. The printing unit 4 includes a plurality of conveying rollers for conveying the sheet. In this embodiment, the print heads 14 eject ink droplets through ejection ports to perform printing.

The print heads 14 are inline print heads wherein nozzle arrays of ink jet type are formed within a range that covers the maximum width of a sheet available for employment. For the individual print heads 14, ejection port arrays are located in a direction that intersects the sheet conveying direction. Further, the print heads 14 prepared for the individual printing colors are arranged so parallel to each other in the sheet conveying direction.

In this embodiment, seven print heads 14 are provided in consonance with seven colors, C (cyan), M (magenta), Y (yellow), LC (light cyan), LM (light magenta), G (gray) and K (black). The number of printing colors and the number of print heads 14 are not limited to seven, and a different number of colors and print heads 14 may also be prepared. The ink jet printing system can, for example, be a system employing heat generating elements, a system employing piezoelectric elements, a system employing electrostatic elements or a system employing MEMS elements. The individual color inks are supplied from ink tanks prepared for corresponding colors through ink tubes to the corresponding print heads 14.

The inspection unit 5 performs the inspection for an inspection pattern and an image printed on the sheet by the printing unit 4. During the inspection, a scanner optically reads an image. When an image read by the inspection unit 5 is analyzed, the state of the ejection ports of the print heads 14, the sheet conveying condition and the position of a printed image, for example, are examined to determine whether or not the image has been correctly printed. A CCD image sensor or a CMOS sensor is employed as a scanner.

The cutter unit 6 is a unit that includes a mechanical cutter that cuts a printed sheet into a predetermined length. The cutter unit 6 also includes a plurality of conveying rollers for conveying the sheet to the next processing step.

The information recording unit 7 is a unit that records print information (inherent information), such as a serial number and a date for printing, to a non-printing area of the cut sheet. For the recording of this information, the information recording unit 7 prints characters or codes on the sheet using the ink jet or thermal transfer method. A sensor 17 that detects the leading edge of the cut sheet is provided upstream of the information recording unit 7 and downstream of the cutter unit 6. That is, the sensor 17 is located between the cutter unit 6 and the recording portion by the information recording unit 7 to detect the leading edge of the sheet portion. Based on the detected timing, the timing at which the information recording unit 7 records information is controlled.

The drying unit 8 is a unit that heats the sheet printed by the printing unit 4, and dries the ink applied to the sheet in a short period of time. When the sheet is passing inside the drying unit 8, warm air is blown onto the sheet at least from below to dry the ink applied face. The drying method is not limited to a warm air blowing method, but may be a method for exposing the surface of the sheet to electromagnetic waves (ultraviolet rays, infrared rays, etc.).

The above described sheet conveying path, extended from the sheet feeding unit 1 to the drying unit 8, is regarded as a first path. The first path has a U shape by being curved twice between the printing unit 4 and the drying unit 8. The cutter unit 6 is located in the middle of the U-shaped portion.

The inversion unit 9 is a unit that temporarily winds the continuous sheet, for which printing for the obverse side has been completed, and inverts the sheet for the double-sided printing. The inversion unit 9 inverts the sheet for which printing has been performed on the obverse face, and thereafter, again feeds the sheet to the printing unit 4, so that the printing unit 4 can perform the printing of the reverse side of the sheet. The sheet that has passed the drying unit 8 is temporarily wound by the inversion unit 9, and then is supplied to the decurling unit 2. The inversion unit 9 is located in the middle of a path (a slack path) extended from the drying unit 8 via the decurling unit 2 to the printing unit 4 (this path is hereinafter referred to as a second path). The inversion unit 9 includes a winding rotary member (drum) that rotates to wind the sheet. The continuous sheet, for which printing for the obverse side has been completed, and not yet cut, is temporarily wound around the winding rotary member. After the sheet has been wound, the winding rotary member is rotated in reverse, and the wound sheet is fed in the order opposite to the winding order, and is conveyed to the decurling unit 2 and to the printing unit 4. Since the sheet at this time has been inverted from the sheet during printing of the obverse side, the printing unit 4 can print onto the reverse side. The double-sided printing operation will be more specifically explained later.

The delivering/conveying unit 10 is a unit that conveys the sheet that has been cut by the cutter unit 6 and been dried by the drying unit 8, and delivers the sheet to the sorter unit 11. The delivering/conveying unit 10 is located along a path (referred to as a third path) that is different from the second path along which the inversion path 9 is located. A path switching mechanism that includes a movable flapper is arranged at a path branch location in order to selectively guide, either to the second or the third path, the sheet that has been conveyed along the first path.

The sorter unit 11 and the discharging unit 12 are arranged at lateral portion of the sheet feeding unit 1 and at the terminal end of the third path. The sorter unit 11 is a unit that sorts the printed sheet into groups, as needed. The sorted sheets are discharged to the discharging unit 12 that includes a plurality of trays. As described above, the third path is extended below the sheet feeding unit 1 so as to discharge the sheet to the side opposite the printing unit 4 and the drying unit 8 across the sheet feeding unit 1.

As described above, the units, beginning from the sheet feeding unit 1 and continuing until the drying unit 8, are arranged in order along the first path, in the conveying path of the sheet. The conveying path branches to the second path and the third path at ahead of the drying unit 8. The inversion unit 9 is located along the second path, and the second path merges with the first path at ahead of the inversion unit 9. Furthermore, the discharging unit 12 is located at the terminal end of the third path.

The control unit 13 is a unit that conducts control for all the units of the printing apparatus 100. The control unit 13 includes a CPU, a storage device, a controller that has various control sections, an external interface, and an operating unit 15 employed by a user to enter an input/output instruction. The operation of the printing apparatus 100 is controlled based on an instruction issued by the controller or a host apparatus 16, such as a host computer, connected to the controller via the external interface.

Figure 2:
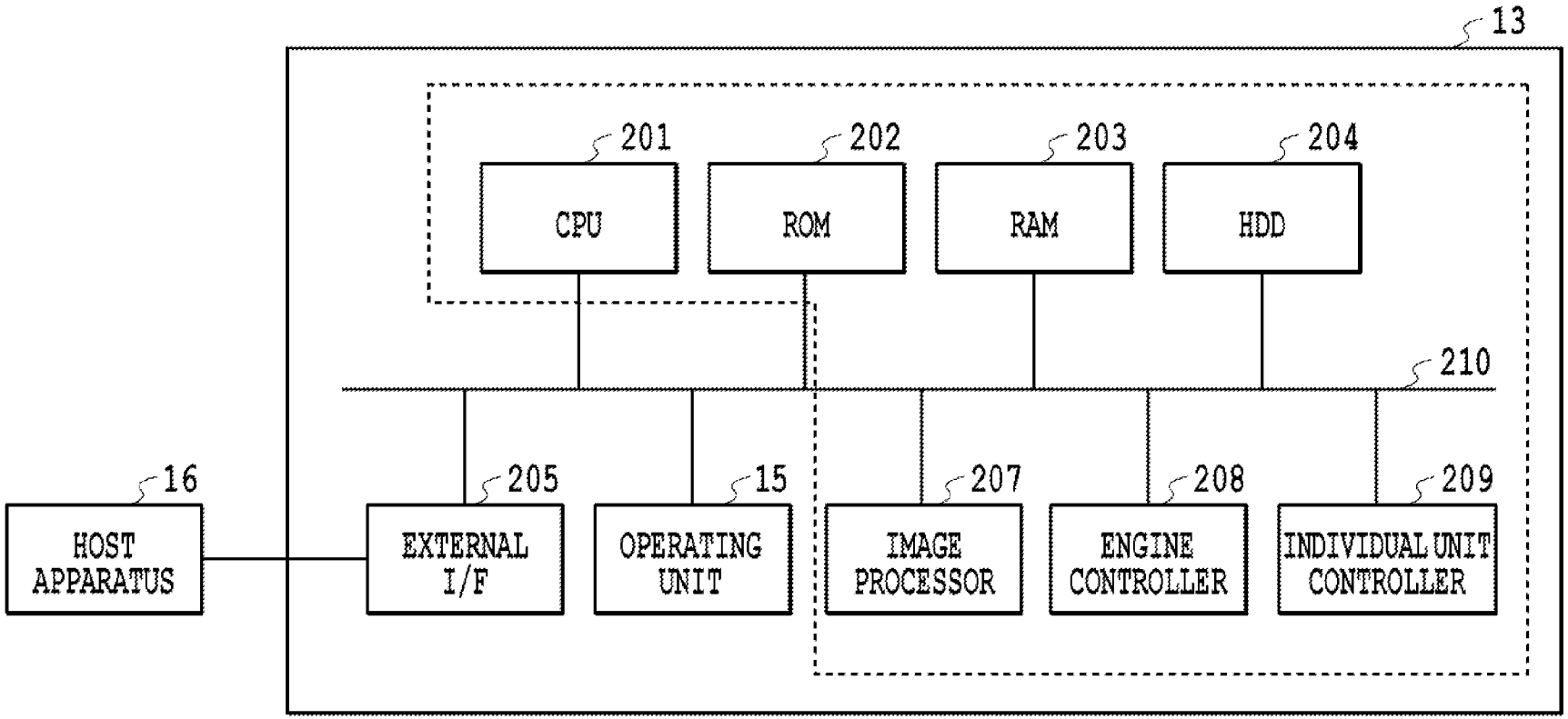
FIG. 2 is a schematic block diagram illustrating the arrangement of the control system of the printing apparatus in FIG. 1.

FIG. 2 is a block diagram illustrating the arrangement of the control system of the control unit 13. The controller (enclosed by a broken line) in the control unit 13 includes a CPU (Central Processing Unit) 201, a ROM 202, a RAM 203, an HDD (Hard Disk Drive) 204, an image processor 207, an engine controller 208 and individual unit controller 209. The CPU 201 provides overall control for the operations of the individual units of the printing apparatus 100. The ROM 202 is employed to store programs executed by the CPU 201 and fixed data required for various operations of the printing apparatus 100. The RAM 203 is employed as a work area for the CPU 201 and as a temporarily storage area for various received data, and is also employed for storing various setup data. The HDD 204 is employed to store or retrieve programs executed by the CPU 201, print data, and setup information required for various operations performed by the printing apparatus 100. The operating unit 15 serves as an input/output interface, relative to a user, and includes input units, such as hardware buttons and a touchscreen, and output units, such as a display and an audio generator, for presenting information.

A special processor is provided for a unit for which fast data processing is required. The image processor 207 performs image processing for print data handled by the printing apparatus 100, and converts the color space (e.g., YCbCr) of input image data into the standard RGB color space (e.g., sRGB). Further, as needed, the image processor 207 also performs various other image processes, such as resolution conversion, image analysis and image correction, for the image data. The print data obtained through the image processing is stored in the RAM 203 or in the HDD 204. The engine controller 208 receives a control command from the CPU 201, for example, and based on the control command, the engine controller 208 controls driving of the print heads 14 of the printing unit 4 in accordance with the print data. The engine controller 208 also controls the individual conveying mechanisms of the printing apparatus 100. The individual unit controller 209 is a sub-controller that individually controls the sheet feeding unit 1, the decurling unit 2, the positional deviation correction unit 3, the inspection unit 5, the cutter unit 6, the information recording unit 7, the drying unit 8, the inversion unit 9, the delivering/conveying unit 10, the sorter unit 11 and the discharging unit 12. Based on a command issued by the CPU 201, the individual unit controller 209 controls the operations of the individual units. The external interface 205 is an interface (I/F), such as a local I/F or a network I/F, used to connect the controller to the host apparatus 16. The above described components are interconnected by a system bus 210.

The host apparatus 16 serves as a supply source for image data to be printed by the printing apparatus 100. The host apparatus 16 may be a general-purpose or special-purpose computer, or may be a dedicated image apparatus, such as an image capture apparatus having an image reader, a digital camera or a photo storage device. When a computer is employed as the host apparatus 16, an OS, application software for generating image data and a printer driver for the printing apparatus 100, should be installed in the storage device of the computer. It should be noted that not all of the processes described above need be performed by software, and that one or all of the processes may be provided by hardware.

The basic operation in the printing mode will now be described. Since different operations are performed between the single-sided printing mode and the double-sided printing mode, the operations for the individual modes will be described below.

Figure 3A:
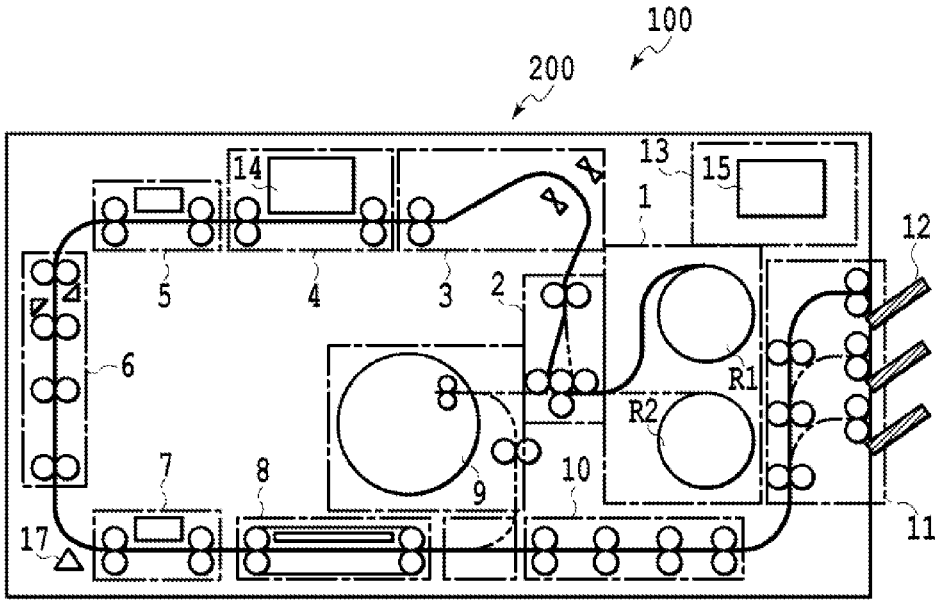
FIG. 3A is an explanatory diagram for explaining a sheet conveying path employed for single-sided printing.

FIG. 3A is an explanatory diagram for explaining the operation of the printing apparatus 100 in the single-sided printing mode. First, the operation in the single-sided printing mode will be described. A sheet is supplied by the sheet feeding unit 1, and is processed by the decurling unit 2 and the positional deviation correction unit 3, and thereafter, printing on the obverse face (first side) of the sheet is performed by the printing unit 4. For the continuous sheet, an image having a predetermined unit length in the conveying direction (a unit image) is sequentially printed. As a result, a plurality of images are formed in parallel on the sheet, print images are formed on the sheet. The printed sheet is conveyed through the inspection unit 5, and is cut by the cutter unit 6 for the individual unit images. Thereafter, print information is printed, as needed, on the reverse faces of the obtained cut sheets by the information recording unit 7. Thereafter, to dry the sheets, the cut sheets are conveyed one by one to the drying unit 8. Thereafter, the cut sheets are sequentially conveyed via the delivering/conveying unit 10 to the discharging unit 12 of the sorter unit 11, and are discharged and stacked on the trays. Meanwhile, after the last unit image portion has been cut off, the sheet portion that remains on the side of the printing unit 4 is fed back to the sheet feeding unit 1, and is rewound around the roll R1 or R2.

As described above, in the single-sided printing mode, the sheet is conveyed and processed along the first path and the third path. In this mode, the sheet does not pass the second path. In conclusion, in the single-sided printing mode, the following sequence from (1) to (6) is performed under the control of the control unit 13.

(1) The sheet feeding unit 1 feeds the sheet to the printing unit 4.

(2) The printing unit 4 repetitively prints a unit image on the first side of the sheet that is conveyed.

(3) The cutter unit 6 repetitively cuts the sheet for the individual unit images printed on the first side.

(4) The sheet portions obtained by cutting the sheet for the individual unit images are conveyed through the drying unit 8 one by one.

(5) The cut sheets conveyed through the drying unit 8 are conveyed one by one along the third path, and are discharged to the discharging unit 12.

(6) The portion for the last unit image is cut off, and the remaining sheet on the printing unit 4 side is returned to the sheet feeding unit 1.

Figure 3B:
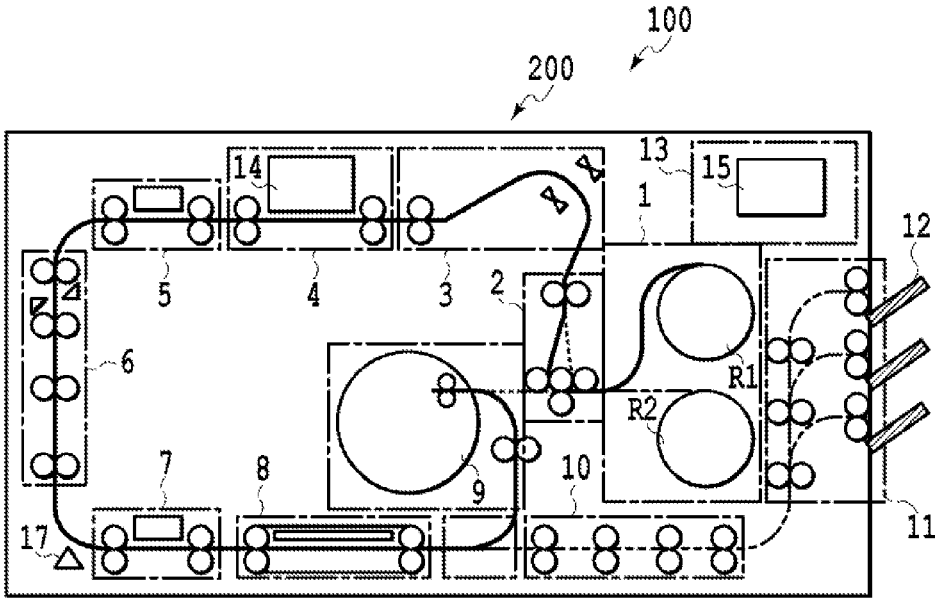
FIG. 3B is an explanatory diagram for explaining a sheet conveying path employed for double-sided printing.

FIG. 3B is an explanatory diagram for explaining the operation of the printing apparatus 100 in the double-sided printing mode. In the double-sided printing mode, the printing sequence for the obverse face (first side) is performed, and thereafter, sequentially, the printing sequence for the reverse face (second side) is performed. In the obverse face printing sequence, the operations performed by the units from the sheet feeding unit 1 to the inspection unit 5 are the same as those in the single-sided printing mode. Thereafter, the cutter unit 6 does not cut the sheet, and the sheet is conveyed to the drying unit 8 as a continuous form. In the double-sided printing mode, after the obverse face of the sheet has been dried by the drying unit 8, the sheet is guided to the path on the inversion unit 9 side (second path), instead of the path on the delivering/conveying unit 10 (third path). The sheet conveyed along the second path is wound around the winding rotary member of the inversion unit 9, which is rotated forward (counterclockwise in FIG. 3B). When the printing unit 4 has performed all scheduled printing for the obverse face, the cutter unit 6 cuts the continuous sheet along the trailing edge of the printing area. The continuous sheet located downstream in the conveying direction (the printed portion side) relative to the cut end as a reference is passed through the drying unit 8, and is fully wound by the inversion unit 9 until the trailing edge of the sheet (the cut end) is reached. Further, at the same time as the winding of the sheet starts, the continuous sheet that remains upstream in the conveying direction (on the printing unit 4 side) relative to the cut end is fed back to the sheet feeding unit 1, so that the leading edge of the sheet (the cut end) does not stay along the conveying path. As a result, the sheet is rewound around the roll R1 or R2. Since the sheet is rewound in this manner, the remainder of the sheet lying along the conveying path does not collide with the sheet that is again fed during the reverse face printing sequence.

As described above, in the double-sided printing mode, the obverse face printing sequence is performed first, and thereafter, the reverse face printing sequence is performed. When the rewound sheet is fed to the conveying path again for the reverse face printing, the winding rotary member of the inversion unit 9 is rotated in the direction opposite to that when winding (clockwise in FIG. 3B).

The edge of the sheet that has been wound (the trailing edge of the wound sheet becomes the leading edge when fed) enters the decurling unit 2 along the path indicated by a broken line in FIG. 3B. The decurling unit 2 removes a curl applied to the sheet by the winding rotary member. That is, the decurling unit 2 performs the decurling of the sheet along the first path between the sheet feeding unit 1 and the printing unit 4, and along the second path between the inversion unit 9 and the printing unit 4. As a result, the decurling unit 2 is employed in common for both the first and the second path to perform decurling. When the sides of the sheet have been inverted, the sheet is conveyed to the positional deviation correction unit 3 and to the printing unit 4, and printing on the reverse face is performed. The printed sheet is passed through the inspection unit 5, and is cut by the cutter unit 6 for each specific unit length, as designated in advance. Since images are printed on both sides of the cut sheets obtained by the cutter unit 6, the information recording unit 7 does not print any information for the sheets. The cut sheets are conveyed, one by one, to the drying unit 8, and to the delivering/discharging unit 10, and are sequentially discharged to the discharging unit 12, of the sorter unit 11, and stacked on the trays.

As described above, in the double-sided printing mode, the sheet is conveyed and processed sequentially along the first path, the second path, the first path and the third path. In conclusion, in the double-sided printing mode, the following printing sequence, from (1) to (11), is performed under the control of the control unit 13.

(1) The sheet feeding unit 1 feeds the sheet to supply to the printing unit 4.

(2) The printing unit 4 repetitively prints the unit image on the first side of the sheet that has been fed.

(3) The sheet that the images are printed on the first side is passed through the drying unit 8.

(4) The sheet that has passed the drying unit 8 is guided to the second path, and is wound around the winding rotary member of the inversion unit 9.

(5) After the repetitive printing for the first side has been completed, the cutter unit 6 cuts the sheet at the rear end where the last unit image has been printed.

(6) The edge portion of the sheet cut is wound around the winding rotary member until the trailing edge of the cut portion has passed the drying unit 8 and has reached the winding rotary member. Further, the portion of the sheet that has been cut and remains on the printing unit 4 side is returned to the sheet feeding unit 1.

(7) When the sheet has been wound around the winding rotary member, the winding rotary member is reversely rotated to again feed the sheet to the printing unit 4 along the second path.

(8) The printing unit 4 repetitively prints the unit image on the second side of the sheet supplied along the second path.

(9) The cutter unit 6 repetitively cuts the sheet for each unit image printed on the second side.

(10) The cut sheets obtained for each unit image are passed, one by one, through the drying unit 8.

(11) The individual cut sheets passed by the drying unit 8 are discharged along the third path to the discharging unit 12.

An explanation will now be given for the operation of thus arranged printing apparatus 100 in which the sheet feeding unit 1 feeds a rolled sheet, the decurling unit 2 performs decurling for the sheet, and the positional deviation correction unit 3 corrects positional deviation for the sheet.

Figure 4A:
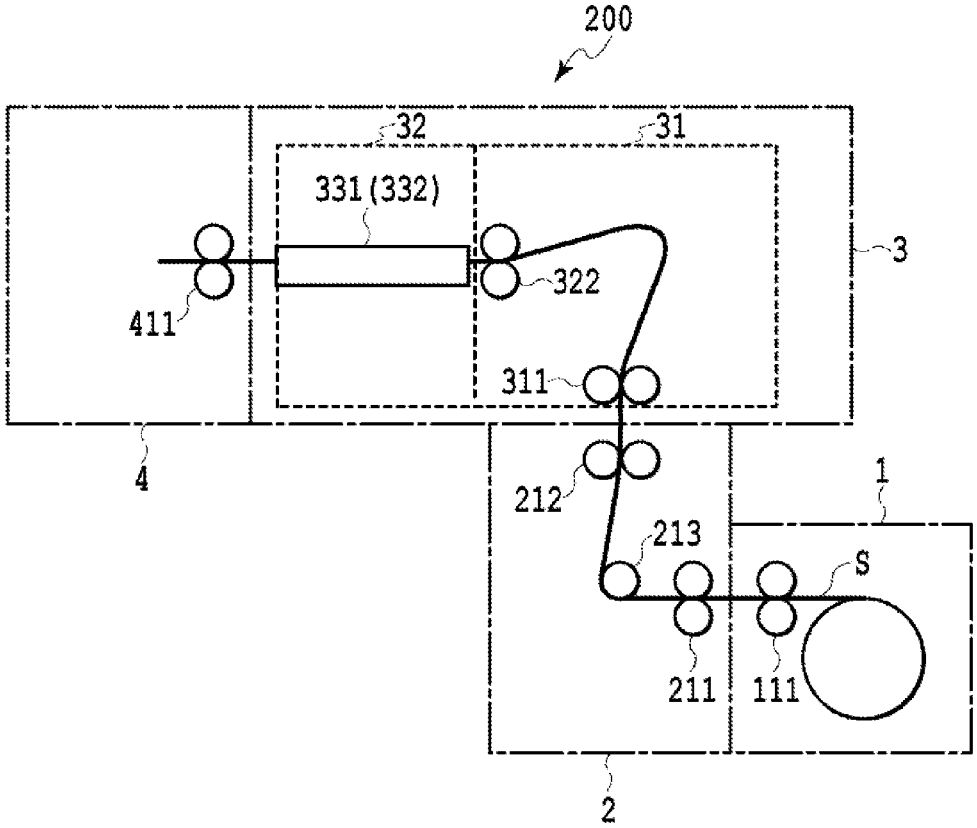
FIG. 4A is a schematic, enlarged cross-sectional view of the periphery of the positional deviation correction unit of the sheet conveying device of the printing apparatus in FIG. 1.
Figure 4B:
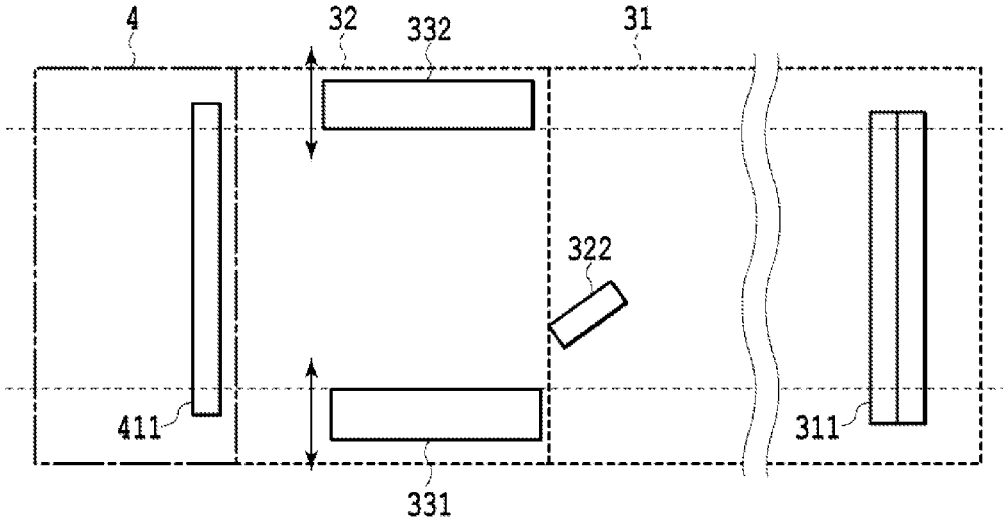
FIG. 4B is a schematic top plan view of the periphery of the positional deviation correction unit.

FIG. 4A is an enlarged cross-sectional view of the sheet feeding unit 1, the decurling unit 2, the positional deviation correction unit 3 and the printing unit 4 of the printing apparatus 100. FIG. 4B is a top plan view of the sheet feeding unit 1, the decurling unit 2, the positional deviation correction unit 3 and the printing unit 4 of the printing apparatus 100. The sheet feeding unit 1 includes a first conveying roller pair 111 for feeding a sheet S from a magazine. The decurling unit 2 includes a second conveying roller pair 211 and a third conveying roller pair 212, for conveying the sheet S to the positional deviation correction unit 3, and a decurling roller 213, for removing a curl from the rolled sheet. The positional deviation correction unit 3 includes a slack buffer (a slack formation unit) 31 that allows the loose of a sheet, and a side guide unit (a guide unit) 32 for correcting the positional deviation of the sheet.

The slack buffer 31 includes a fourth conveying roller pair (an upstream roller pair) 311, with which a slack of the sheet is formed by slackening the sheet. The fourth conveying roller pair 311 is located upstream at the slackened portion by the slack of the sheet. The slack buffer 31 also includes a fifth conveying roller pair (oblique conveying roller pair) 322 that has an oblique feeding function that halts the sheet conveying to slacken the sheet and form a slack, and that obliquely feeds the sheet. The fifth conveying roller pair (an oblique conveying roller pair) 322 is located downstream at the slackened portion of the sheet, and feeds the sheet toward the printing unit 4. The slack buffer 31 slackens the sheet, i.e., forms a slack in the sheet. In the specification of this invention, the slackened portion of the sheet that is extended outside the normal sheet conveying path is referred to as a slack.

The side guide unit 32 includes side guides 331 and 332 to correct a positional deviation of the sheet. The side guides 331 and 332 are provided on the respective sides of the sheet conveying path, and can be moved in a direction perpendicular to the conveying direction. For correcting a positional difference, such as positional deviation of the sheet due to oblique conveying, the sheet is brought into contact with the abutting faces of the side guides 331 and 332 extended along the conveying path, and is guided and conveyed along the side guides 331 and 332. In this manner, when a positional deviation occurs in the sheet, the side guides 331 and 332 guide the sheet to the predetermined location. In the following explanation, among positional differences of the sheet, the positional deviation due to oblique traveling will be especially focused on.

The printing unit 4 includes a sixth conveying roller pair 411 that very accurately conveys the sheet to perform printing. That is, when the sheet is conveyed very accurately by the sixth conveying roller pair 411, the printing unit 4 can accurately perform printing, and the quality of a printed image can be improved. As described above, the sixth conveying roller pair 411 is mainly in charge of conveying during the printing performed by the printing unit 4.

A pinch roller elevation mechanism is provided for the fifth conveying roller pair 322 and the sixth conveying roller pair 411. Therefore, when the driven roller of the roller pair is separated from the drive roller, the sheet can be released from the nip of the roller pair. It should be noted that the elevation mechanism here may employ either a cam or a solenoid for lifting or lowering the roller.

The sheet conveying process performed when the sheet conveying device 200 of this embodiment corrects the positional deviation of a sheet will now be described.

Figure 5A:
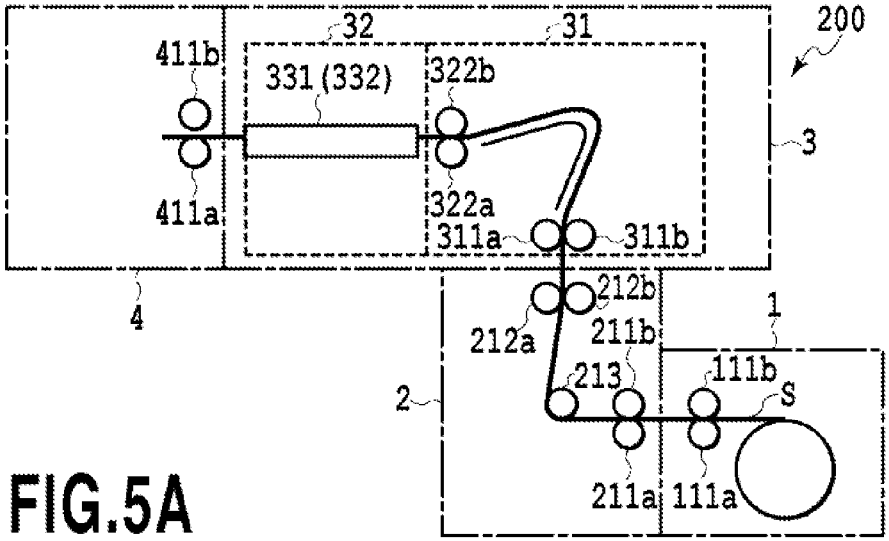
FIGS. 5A to 5C are schematic cross-sectional views of the operation of the sheet conveying device in which the positional deviation correction unit in FIGS. 4A and 4B performs a correction of the positional deviation of a sheet.
Figure 5B:
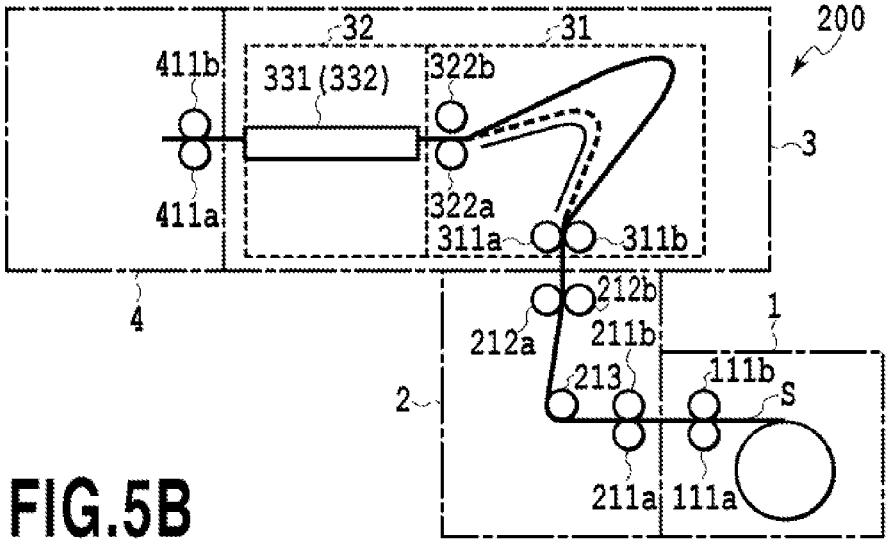
Figure 5C:
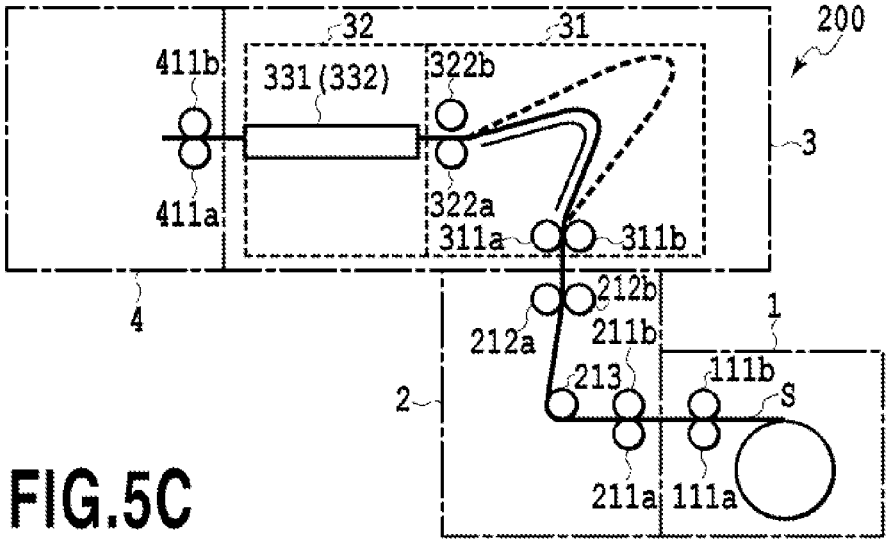

FIGS. 5A to 5C are explanatory diagrams for explaining the operation performed to convey a sheet along the sheet conveying path extending from the sheet feeding unit 1 to the printing unit 4. The sheet feeding unit 1 employs a drive roller 111*a* and a driven roller 111*b* of the first conveying roller pair 111 to nip the sheet, and rotates the drive roller 111*a* to feed the sheet to the decurling unit 2. The decurling unit 2 employs a drive roller 211*a* and a driven roller 211*b* of the second conveying roller pair 211 to nip the sheet, and rotates the drive roller 211*a* to convey the sheet to the sheet conveying path near the decurling roller 213. Thereafter, when the sheet is further conveyed to the third conveying roller 212, also arranged in the decurling unit 2, the decurling unit 2 employs a drive roller 212*a* and a driven roller 212*b* of the third conveying roller 212 to nip the sheet, and rotates the drive roller 212*a* to convey the sheet to the positional deviation correction unit 3.

The positional deviation correction unit 3 can form a comparatively large slack for the sheet between the fourth conveying roller pair 311 and the fifth conveying roller pair (oblique conveying roller pair) 322 of the slack buffer 31. Until a slack has been formed for the sheet, rotation of the fifth conveying roller pair (oblique conveying roller pair) 322 is halted in the state wherein the sheet is nipped between a drive roller (oblique conveying roller) 322*a* and a driven roller (the oblique conveying pinch roller) 322*b*. In the state wherein the sheet is nipped by the fifth conveying roller pair (oblique conveying roller pair) 322, the drive rollers of the first conveying roller pair 111, the second conveying roller pair 211, the third conveying roller pair 311 and the fourth conveying roller pair 411 begin to rotate. As a result, in the state wherein the conveying of the sheet is halted downstream of where the sheet is located, conveying of the sheet is continued upstream where the sheet is located, so that the sheet is slackened between the fourth conveying roller pair 311 and the fifth conveying roller pair (oblique conveying roller pair) 322. Therefore, the sheet is raised above the predetermined conveying path, and is extended outside the predetermined conveying path, and a larger slack than that during the normal conveying process is formed for the sheet. When the slack buffer 31 is employed in this manner to slacken the sheet, the conveying of the sheet is halted downstream of the location where the sheet is to be slackened, while the conveying of the sheet is continued upstream. As a result, a slackened portion for the sheet is obtained. Specifically, rotation of the drive roller (oblique roller) 322*a* of the fifth conveying roller pair (oblique conveying roller pair) 322 is halted, while the drive rollers of the conveying roller pairs located upstream, including the fourth conveying roller pair 311, are rotated to continue the conveying the sheet, and the slackening of the sheet is performed.

After a desired slack has been formed, the fifth conveying roller pair (oblique conveying roller pair) 322 are rotated and bring the end of the sheet S into contact with the side guide 331 to temporarily correct positional deviation caused by the oblique conveying of the sheet. Since the side guides 332 can be moved in a direction perpendicular to the conveying direction, the sheet is pushed by the side guide 332 and the sheet is brought into contact with the side guides 331, by moving the side guide 332, to guide the sheet to the predetermined location.

Sequentially, as shown in FIG. 5B, the sheet is nipped between a drive roller 411*a* and a driven roller 411*b* of the sixth conveying roller pair 411, and thereafter, the nipping of the sheet by the fifth conveying roller pair 322 is released.

During this process, the first conveying roller pair 111, the second conveying roller pair 211, the third conveying roller pair 212 and the fourth conveying roller pair 311, all of which are arranged on the upstream side, continue to convey the sheet. That is, during a period in which the slack buffer 31 forms a slack for the sheet, and correction of the positional deviation of the sheet is performed by guiding the sheet along the side guides 331 and 332, the various conveying roller pairs located upstream continue rotation. Therefore, the temporary halting of the sheet does not occur on the upstream side, and the correction of the positional deviation of the sheet can be performed. Furthermore, since a slack is formed for the sheet, applying of unwanted curls or scratches by the decurling unit 2 can be avoided, when positional deviation of the sheet is corrected.

The drive roller and the driven roller of the fifth conveying roller pair (oblique conveying roller pair) 322 can be separated by, and contact with, the pinch roller elevation mechanism. That is, the drive roller and the driven roller of the fifth conveying roller pair (oblique conveying roller pair) (the downstream roller pair) 322 are separable to release the nipping of the sheet. When the drive roller and the driven roller of the fifth conveying roller pair (oblique conveying roller pair) 322 are separated, part of the slackened portion of the sheet provided by the slack buffer 31 is moved to a position corresponding to the location of the side guides 331 and 332. As described above, when the nipping of the sheet by the downstream roller pair is released, one part of the slack of the sheet formed by the buffer unit is transferred to the downstream guide unit (the side guides 331 and 332).

Under a condition where the sheet is nipped between the drive roller 411*a* and the driven roller 411*b* of the sixth conveying roller pair 411, the conveying of the sheet is performed. At this time, the nipping of the sheet by the fifth conveying roller pair (oblique conveying roller pair) 322 is released. Since the sheet is slackened by forming a comparatively large slack for the sheet, the slackened portion of the sheet is fed downstream by rotating the sixth conveying roller pair 411 and conveyance of the sheet. In this manner, one part of the slack of the sheet is transferred to the downstream guide unit (the side guides 331 and 332).

When both edges of the sheet (both widthwise edges of the sheet) abut upon the side guides 331 and 332, positional deviation of the sheet is corrected. When correction of the positional deviation is performed, a larger slack than that during the normal conveying (printing) is formed for the sheet, and the sheet is slackened even more. Furthermore, since one part of the slackened portion of the sheet, that is formed by loose of the sheet, has been transferred to the position corresponding to the location of the side guides 331 and 332, a tensile force exerted on the sheet in the conveying direction is comparatively reduced, and therefore, it is comparatively easy for the sheet to be moved in the direction perpendicularly to the conveying direction. As a result, the sheet can be easily moved in the direction perpendicular to the conveying direction, and accordingly, positional deviation of the sheet can also be easily corrected. Further, since only a comparatively small force is required to move the sheet in the direction perpendicular to the conveying direction, positional deviation of the sheet can be more quickly corrected. It should be noted that the other deviations for the sheet caused by oblique conveying are be corrected.

As described above, when the portion of the sheet (one part of the slack) slackened by the slack buffer 31 has reached the position corresponding to where the side guides 331 and 332 are located, in a state that the slackened portion is maintained, conveying of the sheet is controlled to guide the sheet in the slackened condition.

Thereafter, as shown in FIG. 5C, the sheet having a comparatively large slack is returned to the original form. In this process, the speed for conveying the sheet S by the sixth conveying roller pair 411 should be greater than the speed for conveying the sheet S by the first, second, third and fourth conveying roller pairs 111, 211, 212 and 311, so that the sheet, for which positional deviation has been corrected, can be returned to the original form. As a result, the downstream portion of the sheet is pulled in the conveying direction, and the sheet having a comparatively large slack is returned to the original form. That is, the drive roller 411*a* of the sixth conveying roller pair 411 is rotated, while at the same time, the first conveying roller pair 111 to the fourth conveying roller pair 311 are rotated at a lower speed than that for the sixth conveying roller pair 411 to return the sheet to a predetermined form along the conveying path. Thereafter, the almost constant conveying speed for the first conveying roller pair 111 to the sixth conveying roller pair 411 is maintained to hold the predetermined form of the sheet along the conveying path.

Figure 6:
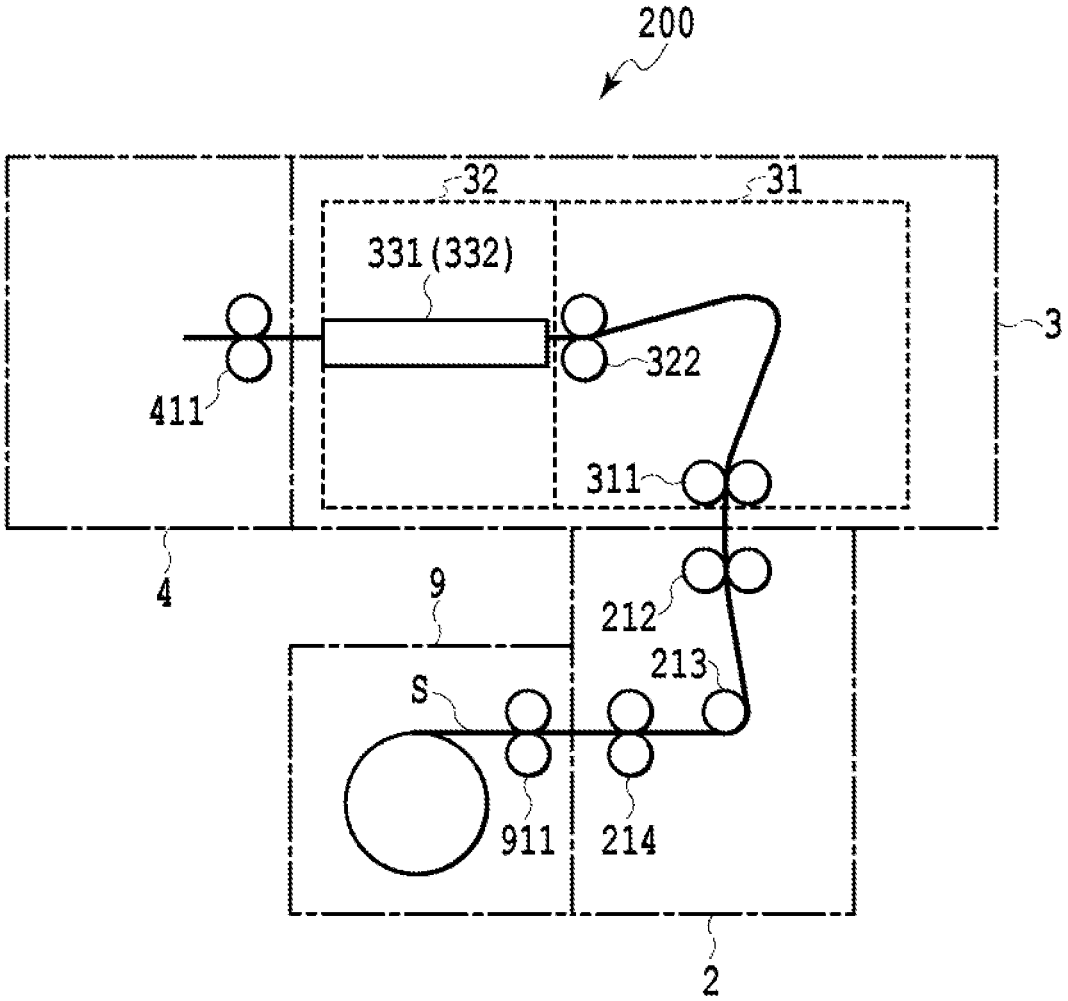
FIG. 6 is a schematic cross-sectional view of a sheet conveying path, extended from an inversion unit, that is employed by the positional deviation correction unit to correct the positional deviation of a sheet when the printing apparatus in FIG. 1 performs the printing, on the reverse face of the sheet, during double-sided printing.

The second path for conveying the sheet is shown in FIG. 6 in a case wherein, for double-sided printing, the sheet for which printing has been performed on the obverse face is to be fed to the second path extended to the inversion unit 9. FIG. 6 is a cross-sectional view of the sheet conveying device 200 where the inversion unit 9, the decurling unit 2, the positional deviation correction unit 3 and the printing unit 4 are arranged. The sheet S wound by the inversion unit 9 is conveyed to the decurling unit 2 by a seventh conveying roller pair 911, and is fed to the third conveying roller pair 212 by an eighth conveying roller pair 214 in the decurling unit 2. The correction of positional deviation is thereafter performed in the same manner as for the operation explained while referring to FIGS. 4A and 4B and FIGS. 5A to 5C.

Figure 7:
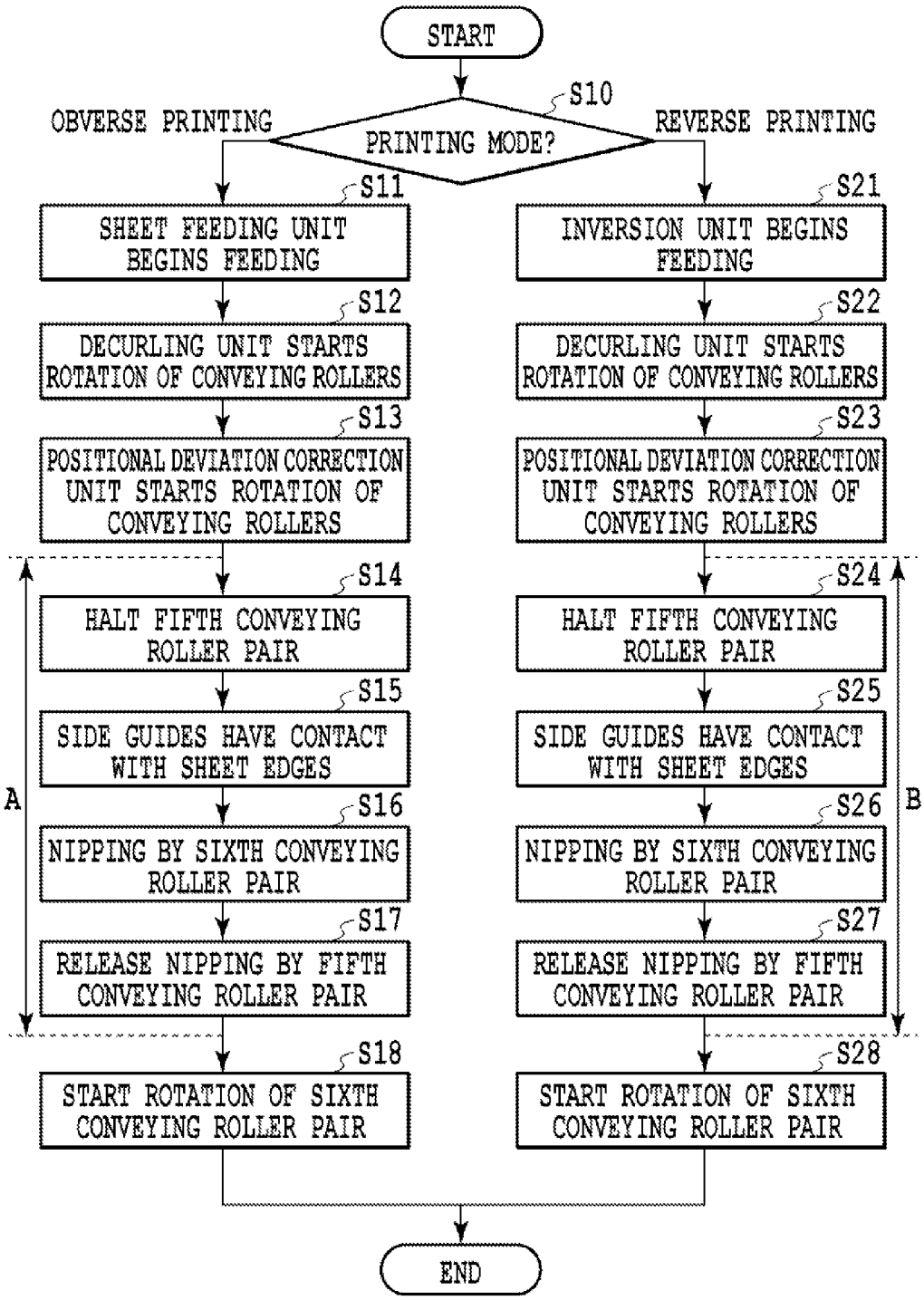
FIG. 7 is a flowchart showing the control processing during which the positional deviation correction unit of the printing apparatus in FIG. 1 performs a correction for the positional deviation of the sheet.

FIG. 7 is a flowchart showing the operation beginning with the feeding of the sheet and continuing until the start of printing. The control flow differs depending on the obverse face printing (printing of the obverse face in the single-sided printing mode and in the double-sided printing mode) and the reverse face printing (printing of the reverse face in the double-sided printing mode). Therefore, at step S10, a judgment is performed to determine whether the printing mode is the obverse face printing, for performing the printing of the obverse face of the sheet, or the reverse face printing, for performing the printing of the reverse face. When the printing mode is the obverse face printing, program control advances to step S11, or when the printing mode is the reverse face printing, program control moves to step S21.

In a case wherein the printing mode is the obverse face printing mode, first, at step S11, the first conveying roller pair 111, provided for the sheet feeding unit 1, is rotated to convey the sheet S to the decurling unit 2. At step S12, the second conveying roller pair 211 and the third conveying roller pair 212, provided for the decurling unit 2, are rotated to convey the sheet S to the positional deviation correction unit 3. At this time, the sheet S is decurled by being conveyed around the decurling roller 213, and the curled portion is corrected. At step S13, the fourth conveying roller pair 311 and the fifth conveying roller pair (oblique conveying roller pair) 322 provided for the positional deviation correction unit 3 are controlled driving. Thereafter, a comparatively large slack of the sheet is formed by the slack buffer 31, while at the same time, the sheet S is conveyed downstream by the sixth conveying roller pair 411 provided for the printing unit 4.

At step S14, in the state wherein the sheet S is nipped by the fifth conveying roller pair (oblique conveying roller pair) 322, the rotation of the fifth conveying roller pair (oblique conveying roller pair) 322 is stopped in order to halt the conveying of the sheet S by the fifth conveying roller pair (the oblique conveying roller pair) 322 and the sixth conveying roller pair 411. At step S15, the side guides 331 and 332 are moved in the direction perpendicular to the conveying direction, and the outer widthwise edges of the sheet, perpendicular to the conveying direction, are brought into contact with the side guides 331 and 332 to correct a positional deviation of the sheet S. At step S16, the pinch roller elevation mechanism (not shown) provided at the sixth conveying roller pair 411 is driven and moves the drive roller and the driven roller close to each other, which in turn nips the leading edge of the sheet S. At step S17, the pinch roller elevation mechanism (not shown) prepared for the fifth conveying roller pair (oblique convening roller pair) 322 is driven to separate the drive roller from the driven roller so that the nipping of the sheet by the fifth conveying roller pair (oblique conveying roller pair) 322 is released.

During a period for the performance of a process A between step S14 and step S17 in FIG. 7, the drive rollers of the first conveying roller pair 111, the second conveying roller pair 211, the third conveying roller pair 212 and the fourth conveying roller pair 311 are continuously driven, parallel to the performance at steps S14 to S17. The rotational speed for all the conveying roller pairs, obtained by driving the drive rollers, may be set either higher or lower than, or equal to the rotational speed employed for the previous processing. When a correction for the positional deviation of the sheet has been performed, at step S18, the sixth conveying roller pair 411 is rotated to perform printing.

When it is judged that the printing mode is the reverse face printing mode at step S10, the process sequence beginning at step S21 is performed. At step S21, the sheet S, wound by the inversion unit 9, is conveyed to the decurling unit 2 by the seventh conveying roller pair 911. At step S22, the eighth conveying roller pair 214 and the third conveying roller pair 212, provided at the decurling unit 2, are rotated to convey the sheet S to the positional deviation correction unit 3. At this time, the sheet S is conveyed around the decurling roller 213 to perform correction of curled portion.

The processes at steps S23 to S28 are performed in the same manner as in the obverse face printing mode. In the reverse face printing mode, as well as in the obverse face printing mode, during a period for the performance of a process B, from step S24 to step S27, the drive rollers of the seventh conveying roller pair 911, the eighth conveying roller pair 214, the third conveying roller pair 212 and the fourth conveying roller pair 311 are continuously driven, in parallel with the performance at steps S24 to S27.

In the above described embodiment, one part of the slack formed by the slack buffer (buffer unit) 31 is guided by employing the side guides 331 and 332 (the guide unit). Therefore, a positional deviation can be appropriately corrected in a short period of time.

Furthermore, when the sheet has been conveyed to the positional deviation correction unit 3, a positional deviation can be corrected without halting the rotation of the conveying roller pairs that are arranged along the conveying paths from the sheet feeding unit 1 and from the inversion unit 9 to the slack buffer unit 31. Therefore, it is possible to avoid the occurrence of a phenomenon such that, when the individual rollers are halted with a time lag due to an error in timings for halting the rollers, or due to a hardware error caused by a manufacturing irregularity in electric boards, a scratch mark or a mark by a roller may appear on the surface of the sheet. Therefore, the degrading of the quality of a printed image can be prevented.

Further, it is also possible to avoid the occurrence of a phenomenon such that, during the positional deviation correction process, when a sheet is not removed from around the decurling roller 213 in the decurling unit 2, or when a sheet is not removed from a sharply bent curved path, the sheet tends to roll. Furthermore, since the sheet has already been slackened when a residual deviation is to be corrected by conveying the sheet using the sixth conveying roller pair 411, a slack is formed larger than one obtained during the usual conveying time, and back tension is reduced. Thus, the sheet can be easily moved in the direction perpendicular to the conveying direction to perform the correction of the positional deviation, and as a result, the positional deviation correction function can be improved.

The printing apparatus that employs a continuous sheet has been described for this embodiment; however, the present invention is not limited to this type of apparatus, and may be applied for an apparatus that conveys and processes cut sheets. Moreover, in this embodiment, in the state wherein the downstream portion of the sheet is nipped by the conveying roller pairs, the upstream conveying roller pairs are continuously rotated to form a slack on the sheet that is larger than one obtained during the usual conveying time. However, the present invention is not limited to this, and a larger slack than one obtained during the usual conveying time may be formed by striking the leading edge of the sheet against the roller to perform the correction of a positional deviation, such as a deviation due to oblique conveying. Further, in this embodiment, the positional deviation of the sheet is corrected when the edge of the sheet in the conveying direction passes between the conveying rollers; however, the present invention is not limited to this timing. The correction of a positional deviation of a sheet may be performed in accordance with an instruction from a user, or may be performed when the sensor of the printing apparatus detects the oblique conveying of the sheet.

The present invention can be broadly applied for sheet conveying operations, performed not only by a printing apparatus that performs printing, but also by another apparatus that performs the predetermined processing (scanning, coating, irradiating, heating or processing) of a sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-217259, filed Sep. 28, 2012, which is hereby incorporated by reference herein in its entirety.

What is claimed is:

1. A sheet conveying apparatus for conveying a sheet in a conveying direction comprising:

a correcting unit for correcting a positional deviation of the sheet by guiding with a guide member an edge of the sheet in a crossing direction that crosses to the conveying direction;

a plurality of conveying roller pairs including a first conveying roller pair and a second conveying roller pair which is positioned downstream of the first conveying roller pair in the conveying direction and upstream of the guide member in the conveying direction; and a conveying control unit configured to control conveying of the sheet by driving of the plurality of conveying roller pairs, wherein a conveying control unit controls conveying the sheet such that (i) the first conveying roller pair is driven before the sheet is nipped by the second conveying roller pair, and (ii) the first conveying roller pair is driven and the second conveying roller pair is not driven after the sheet is nipped by the second conveying roller pair within a predetermined period, wherein the conveying control unit controls so as to continuously drive the first conveying roller pair while correcting the positional deviation by the correcting unit after stopping driving of second conveying roller pair, and wherein the conveying control unit controls a moving unit configured to move the second conveying roller pair between a position where the second conveying roller pair can nip the sheet and a position where each roller of the second conveying roller pair is separate from each other after correcting the positional deviation by the correcting unit.

2. The sheet conveying apparatus according to claim 1, wherein the conveying control unit is further configured to control conveying of the sheet so as to form slack in the sheet by driving the first conveying roller pair and not driving the second conveying roller pair after the sheet is nipped by the second conveying roller pair within the predetermined period.

3. The sheet conveying apparatus according to claim 1, further comprising wherein the plurality of conveying roller pairs further includes a third conveying roller pair which is positioned downstream of the guide member in the conveying direction.

4. The sheet conveying apparatus according to claim 3, wherein the conveying control unit controls conveying the sheet so as to continuously drive the first conveying roller pair and start driving of the third conveying roller pair after the moving unit moves the second conveying roller pair to the position where the rollers of the second conveying roller pair are separate from each other.

5. The sheet conveying apparatus according to claim 4, wherein the conveying control unit controls conveying the sheet so as to drive the first conveying roller pair and the third conveying roller pair such that a conveying speed by driving the third conveying roller pair is higher than a conveying speed by driving the first conveying roller pair.

6. The sheet conveying apparatus according to claim 1, wherein the second conveying roller pair is arranged in the sheet conveying apparatus so as to convey the sheet in a diagonal direction which crosses both the conveying direction and the crossing direction.

7. The sheet conveying apparatus according to claim 1, wherein the conveying control unit controls conveying the sheet such that (i) a first conveying roller pair group is driven before the sheet is nipped by the second conveying roller pair, the first conveying roller pair group being a group from the plurality of conveying roller pairs comprised of all conveying roller pairs positioned upstream of the second conveying roller pair in the conveying direction, (ii) the first conveying roller pair group is driven and the second conveying roller pair is not driven after the sheet is nipped by the second conveying roller pair within the predetermined period, and (iv) the first conveying roller pair group is continuously driven while correcting the positional deviation by the correcting unit after stopping driving of second conveying roller pair.

8. The sheet conveying apparatus according to claim 1, further comprising a reducing unit configured to reduce a curl for the sheet in a decurling part in the sheet conveying apparatus, wherein the first conveying roller pair is positioned in the decurling part.

9. The sheet conveying apparatus according to claim 1, wherein the second conveying roller pair is positioned nearby the guide member.

10. The sheet conveying apparatus according to claim 1, further comprising a printing unit configured to print an image on the sheet in a printing part in the conveying apparatus, the printing part being positioned downstream of the guide member in the conveying direction.

11. The sheet conveying apparatus according to claim 10, further comprising a reversing unit configured to reverse the sheet in a reversing part in the conveying apparatus, the reversing part being positioned downstream of the printing area in the conveying direction, wherein the sheet reversed by the reversing unit is again fed to the decurling part.

* * * * *